United States Patent [19]

Liebich

[11] Patent Number: 5,018,536

[45] Date of Patent: May 28, 1991

[54] METHOD AND TOBACCO PRODUCT FOR USE BY THE CONSUMER FOR MAKING CIGARETTES

[76] Inventor: Max Liebich, Bürgerholzring 9, D-8370 Regen, Fed. Rep. of Germany

[21] Appl. No.: 80,257

[22] Filed: Jul. 24, 1987

Related U.S. Application Data

[63] Continuation of Ser. No. 591,869, Mar. 21, 1984, abandoned.

[30] Foreign Application Priority Data

Mar. 28, 1983 [DE] Fed. Rep. of Germany ..... 3311248
Oct. 17, 1983 [DE] Fed. Rep. of Germany ..... 3337688

[51] Int. Cl.[5] ..... A24C 5/00
[52] U.S. Cl. ..... 131/70
[58] Field of Search ..... 131/70, 77

[56] References Cited

U.S. PATENT DOCUMENTS 3,927,681 12/1975 Bramhill ..... 131/70

FOREIGN PATENT DOCUMENTS 427582 5/1911 France .
143981 2/1981 Norway .

*Primary Examiner*—V. Millin

*Attorney, Agent, or Firm*—Ostrolenk, Faber, Gerb & Soffen

[57] ABSTRACT

A method and a set of materials with which the consumer can make high-quality cigarettes without the disadvantages of known stuffing devices and without manual skill.

A manufactured prefabricated sheath tobacco skein, not in itself smokable, comprises skein sheath which is open at the end faces and a skeinlike tobacco filling which can be transferred by means of a plunger enclosed in the packet into a cigarette paper shell. The sheathed tobacco skein is introduced into a prefabricated cigarette shell, or a cigarette paper is gummed round said skein, and the skeinlike tobacco filling is then pushed by the plunger, which is introduced into the skein sheath out of the sheathing and into the cigarette shell or the shell gummed together from cigarette paper.

The sheathed tobacco skein ("cigarette tobacco cartridge") can be provided at one end with a movably inserted or attached plug which provides an additional guarantee of the required non-smokability of the cigarette tobacco cartridge and facilitates handling of the cartridge. Furthermore, the sheathed tobacco skein may be provided at one end at the outside of the skein sheath with a reinforcement ring for further facilitating handling.

22 Claims, 5 Drawing Sheets

Figure 1:
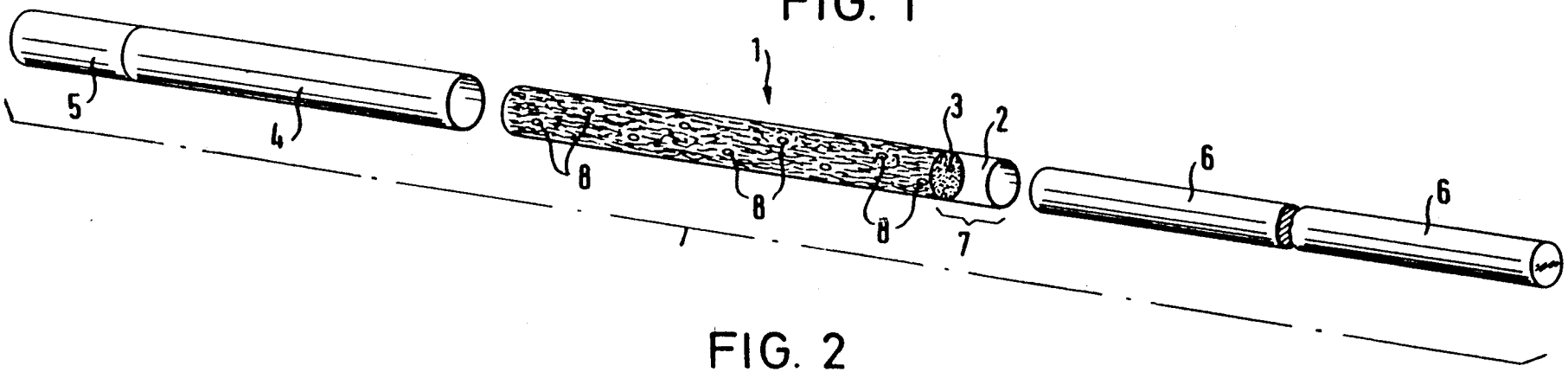

1
2
3
9a
9b
9c
9d
9e
15
16
17
18

METHOD AND TOBACCO PRODUCT FOR USE BY THE CONSUMER FOR MAKING CIGARETTES

This is a continuation of application Ser. No. 591,869, filed on Mar. 21, 1984, now abandoned.

The invention relates generally to the making of cigarettes by the consumer himself.

The making of cigarettes by the smoker himself has been known in a variety of forms for a long time. Thus, it is known in particular for the smoker to roll his own cigarettes using the conventional cigarette papers preferably provided with an adhesive gummed edge. Rolling one's own cigarettes requires a certain amount of manual skill and a certain amount of time; even when made by persons practiced in rolling in their own cigarettes, self-rolled cigarettes vary a great deal over their length as regards size (diameter), firmness and degree of filling and on the whole represent only a primitive substitute for industrially made cigarettes. Also troublesome when the smoker rolls his own cigarettes manually is the inevitable crumbling of tobacco which on the whole also impairs the yield, i.e. the number of cigarettes which can be rolled by the smoker himself with a given packet of cigarette fine cut tobacco. Admittedly, various small devices for rolling one's own cigarettes are known; apart from the troublesome necessity for the smoker, if he does not want to roll a stock of cigarettes in advance, to carry the small device about with him apart from cigarette tobacco packet or pouch, the rolling of cigarettes with such devices still requires a certain amount of manual skill and the uniformity of the cigarettes rolled therewith is likewise still not satisfactory as regards thickness, packing density and degree of filling.

The same applies to the other fundamental method of making one's own cigarettes, i.e. the stuffing of cigarettes. For this purpose, prefabricated commercially available shells (usually with filter piece) are used which with the aid of special stuffing means in the form of small devices are stuffed by the consumer himself. Various forms of systems of this type and stuffing means for them are known. Thus, for example, Austrian patent 146,213 shows a known type of stuffing means having two pivot halves connected by a displacement hinge; in the opened position the user inserts and spreads the tobacco; the two halves are then pivoted together about the hinge axis and the one half locked in the closure position by axial longitudinal displacement with respect to the other stationary half; the tobacco filling is then transferred from the device thus closed into a shell drawn thereover. French patent 427,582 discloses for example a cigarette stuffing device of one-part type in the form of a trough-like body of a flexible resilient material whose two legs are beaded over at their ends to form locking eyes. In the non-locked open position in which the two legs of the trough are apart due to the inherent elasticity of the material the trough is filled with tobacco and the latter distributed therein, the trough then closed by pressing the two leg ends together until they mutually lock and the tobacco filling then introduced with a conventional filler into cigarette shell pushed over the end of the trough. U.S. Pat. No. 638,904 discloses a stuffing device in which a stuffing sleeve (integral, which cannot be pivoted open) comprising an associated plunger means is combined to form a constructional unit.

The stuffing sleeve is open at its one end and closed at its other end with a passage opening for the plunger rod. The filling of the stuffing sleeve with tobacco must take place from the open end face of the stuffing sleeve which obviously encounters difficulties in practice in particular when using high-quality long-strand tobacco. Thereafter, the tobacco filling (introduced from the end face into the tube) is transferred by displacing the plunger from the other side into a cigarette shell pushed onto the open end of the stuffing sleeve.

These methods for the filling of cigarettes by the consumer himself also require a certain manual skill in handling the stuffing device and the quality of the self-stuffed cigarettes is also not satisfactory as regards uniformity of the degree of filling; furthermore because of the necessity of using a small device this method is practically restricted to making a supply of cigarettes in advance.

On the whole, the hitherto known methods enabling the smoker to make his own cigarettes, either by rolling them or stuffing them, are defective and unsatisfactory in many respects. Nevertheless, in recent years an increasing number of smokers are making their own cigarettes; this may be due partly to a certain fashion ("nostalgia wave"); to an increasing extent however financial considerations and the desire of the consumers to economize have become significant. This applies in particular since the drastic price increases for cigarettes made industrially on a large scale (that is both for the brand cigarettes and for the so-called brand-free cheap cigarettes).

These drastic price increases are in turn due to the extremely high tax to which the industrial manufacture of cigarettes is subjected with the cigarette tax. Thus, generally speaking there is a continuing or even increasing widespread need for the making of cigarettes by the consumer himself from the cigarette fine-cut tobaccos offered by the tobacco industry.

The invention is based on the problem of providing a system with which the consumer can make his own cigarettes which is extremely simple in manipulation and does not require from the user any particular skill or practice whatever and for which furthermore no separate means or devices are required and which consequently does not necessarily involve making a stock of cigarettes in advance but permits the making as required of one or a few cigarettes when the consumer intends to smoke them, and with which above all in spite of the simple manipulation requiring no special skill and no special equipment a high quality of the cigarettes made by the smoker himself is insured as regards uniformity of the tobacco amount used, the degree of filling and the packing density, in such a manner that the cigarettes thus obtained are to the consumer effectively an equivalent substitute for industrially produced cigarettes. In addition, in spite of part of the overall making of the cigarette being carried out in advance in industrial production, the burdening of the smoker with the (relatively high) cigarette tax is to be avoided, i.e. an economic advantage (freedom from cigarette tax) essential to the making of cigarettes by the smoker himself is to be retained in full for the consumer.

The system according to the invention provided for solving this problem is characterized, by a prefabricated product not in itself smokable in the form of an industrially prefabricated sheathed tobacco skein which is open at the end faces and comprises a skein sheath which is open at the end faces and the diameter of which is adapted to the cigarette paper shell of the finished cigarette and a skeinlike tobacco filling, and an associated plunger adapted to the internal diameter of the skein sheath for transferring the tobacco filling from the skein sheath into a cigarette paper shell.

This system according to the invention is suitable for use both in conjunction with conventional cigarette shells to be stuffed by the smoker himself or in conjunction with conventional cigarette paper for rolling one's own cigarettes; the making of the cigarette by the consumer with the aid of the system according to the invention is effected in the simplest possible manner in that the skeinlike tobacco filling of the sheathed tobacco skein open at the end faces is transferred with the aid of the plunger introduced into the skein sheath by being pushed out of the latter into a prefabricated cigarette shell or into a shell gummed together from cigarette paper.

The invention also relates to a (industrially prefabricatable) tobacco product for use for the making of cigarettes by the consumer himself according to the system of the invention. This tobacco product according to the invention for the making of cigarettes by the consumer himself is characterized by a prefabricated product not in itself smokable in the form of an industrially prefabricated sheathed tobacco skein which is open at the end faces and comprises a skein sheath which is open at the end faces and the diameter of which is adapted to the cigarette paper shell of the finished cigarette and a skeinlike tobacco filling which corresponds in each case to a cigarette portion and which by an associated plunger adapted to the internal diameter of the skein sheath is transferable from the skein sheath into a cigarette paper shell.

Figure 2:
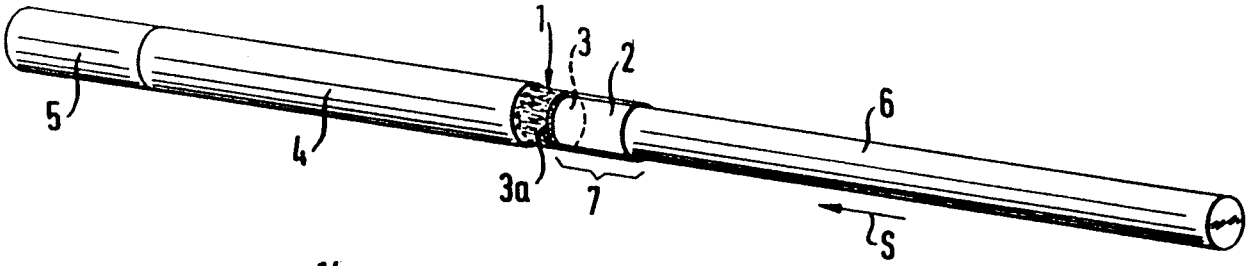
Figure 3:
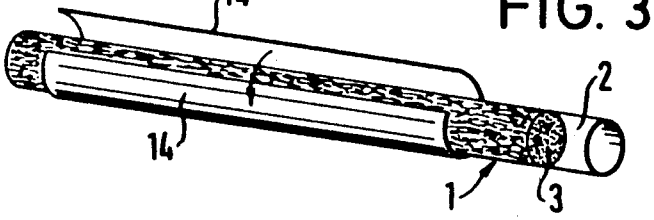

The invention relates also to the method with which the consumer can make his own cigarettes using the system according to the invention, the procedure adopted being that the skeinlike tobacco filling of the sheathed tobacco skein is transferred with the aid of the plunger introduced into the skein sheath by being pushed out of the latter into a prefabricated cigarette shell (4, FIGS. 1 and 2) or into a shell gummed together from cigarette paper (14, FIG. 3).

According to the basic idea of the invention an exactly proportioned amount of tobacco, corresponding for example to the filling amount of a conventional industrially produced cigarette, is made available to the consumer in a prepared sheathed tobacco skein open at the end faces ("cigarette tobacco cartridge") whose tobacco filling can be transferred in simple manner into a prefabricated cigarette shell of usual commercially available type or to a cigarette shell gummed from a roll-your-own cigarette paper. The sheathed tobacco skeins open at the end faces according to the invention can be packed for example just like loose cigarette fine cut tobacco in packages or suitable bunches; for example, with 50 g cigarette tobacco about 50 sheathed tobacco skeins according to the invention can be made, and possibly with each such packet one or more plungers in the form of circular rods may be enclosed.

Canadian patent 771,426 and German patents 602,151, 873,915 and 894,975 disclose industrially prefabricated "pipe tobacco cartridges" which are adapted to be inserted as such into a pipe bowl and smoked in the latter. These known pipe tobacco cartridges are thus a finished product intended and suitable for direct consumption by the user (pipe smoker); the pipe tobacco cartridges concerned are burnable and smokable as a whole in their prefabricated state; after insertion in the (possibly specifically adapted) pipe bowl the cartridge as a whole is directly ignited and smoked; in the case of the tobacco cartridges (for instance according to DE-PS 894,975) made with a sheathing which itself is combustible the tobacco filling with sheath is ignited and smoked and in the case of the use of a sheathing not itself combustible (aluminum foil in CA 771,426) the tobacco filling is ignited and smoked, the ash remaining behind in the incombustible aluminum sheathing.

These publications do not disclose the fundamental idea of the present invention, i.e. the use of an industrially prefabricated sheathed tobacco skein as intermediate product for further use by the consumer for making his own cigarettes.

The sheathed tobacco strand or skein open at the end faces and forming the essential part of the system according to the invention can be economically mass produced industrially similarly to conventional cigarettes. The production costs for the sheathed tobacco skein including the costs of the skein sheath, the tobacco filling, the filling operation (and the costs for the plunger to be enclosed with a large number of tobacco skeins) are extremely low. It is important that the industrially prefabricated sheathed tobacco skeins ("cigarette tobacco cartridges") open at the end faces of the system according to the invention are not in themselves smokable; this can be ensured for example by making the skein sheath from a material which is not suitable for smoking, for example from a thin plastic foil material or from tin or aluminum foil; according to a preferred embodiment alternatively or additionally the skein sheath may be provided with perforations. The skein sheath could then possibly also consist of a highly perforated poorly combustible paper. This ensures with certainty that the sheathed filled tobacco skeins which form the essential element of the system of the invention can be made industrially and thus brought onto the market, are not smokable and consequently from the point of view of the fiscal laws as well cannot be regarded as cigarettes and subjected to the high cigarette tax.

It is already known in finished cigarettes industrially produced in conventional manner to use instead of the usual cigarette shell of paper a shell of another material. In particular DE-OS 2,555,957 discloses a finished cigarette having a shell of aluminum foil or of aluminum/paper composite material . DE-OS 2,429,783 also discloses for an industrially finished cigarette (or cigar or cigarillo) the use of a shell material (covering sheet) of a particular nature that is instead of paper or tobacco covering sheet a wrapping of sheet material containing one or more polysaccharides. In the present context the important point is that in these known systems the wrapping of aluminum foil (or aluminum foil/paper composite material) or of a polysaccharide sheet material forms the permanent final cigarette shell of the finished cigarette (made industrially in conventional manner). These publications also do not disclose the essential aspect of the present invention of using an industrially prefabricated sheathed tobacco skein as non-smokable intermediate product for further use by the consumer in making the finished cigarette himself.

According to advantageous further developments of the system of the invention it maybe provided that the skein sheath comprises at its one end a portion free from the tobacco filling, achieving an easier insertability of the plunger and initial plunger guiding during the pushing of the tobacco filling skein out of the skein sheath; furthermore, it is preferably provided that the sheathed tobacco skein with the skein sheath has a somewhat greater length than the filling length of the cigarette shell or than the length of the cigarette paper. This makes it possible for the tobacco filling in the prefabricated skein to be made somewhat looser than corresponds to the packing density in the subsequent finished cigarette; this somewhat looser packing facilitates the transfer of the tobacco filling from the skein sheath. The compacting of the tobacco filling transferred into the cigarette shell is possible by means of the plunger during and after the transfer operation in simple manner.

On the whole the invention provides a system by which the consumer can make his own cigarettes which in a technically and economically optimal manner obtains the advantages of the highly developed largely automated industrial cigarette production technique for the increasing number of persons who roll or stuff their own cigarettes by making available to such persons an intermediate product suitable for the problemless finishing of the cigarette by the consumer. Apart from the making of uniformly filled cigarettes in a manner simple to the user and involving no problems whatever, as well as requiring no skill and no special devices, the system according to the invention has the further advantage that due to the additional enclosing with the skein sheaths the tobacco better retains its freshness, the correct moisture content and aroma.

According to an advantageous further development of the invention it is possible to provide that the sheathed tobacco strand ("cigarette tobacco cartridge") is provided at its one end face with a plug or stopper which is in close engagement with its outer periphery with the inside of the skein sheath but is axially displaceable with respect to the latter.

The arrangement of such a loose and axially displaceable plug at the one end of the tobacco cartridge open at the end faces provides firstly an additional guarantee of the non-smokability of the cigarette tobacco cartridge; secondly, the plug slidingly movable in the skein wrapper or sheathing can also serve as plunger head in the transfer of the tobacco skein from the sheath to the final cigarette paper shell in such a manner that the associated displacement plunger may not be dimensioned in its diameter exactly to the internal diameter of the sheath, thus simplifying the introduceability of the displacement plunger; possibly, a separate displacement plunger can even be dispensed with and the transfer effected with any sufficiently thin elongated object such as a pencil or the like which is placed against the outer end face of the plug.

According to alternative possible embodiments the plug may either be disposed within an end portion at the one end of the skein sheath open at its end faces with the outer periphery of said plug bearing against the inner wall of the sheath or alternatively the plug can be disposed adjoining the one open end of the skein sheath in coaxial alignment with the latter.

According to a particularly advantageous further development of the latter alternative, it is possible for the plug to be made in two parts having a plug core and a cover surrounding said core, the plug core being adapted in its external diameter to the internal diameter of the adjacent open end of the sheath and being a loose fit the plug cover, said cover being fixedly connected to the adjoining region of the outer wall of the skein sheath by an outer connecting element. This permits in the manner explained below a particularly simple industrial production of the cigarette tobacco cartridge provided with plug with extensive adoption of the existing sophisticated production technique for filter cigarettes.

According to a further improvement aspect it can be provided that the sheathed tobacco skein ("cigarette tobacco cartridge") is provided at its one end at the outer side of the skein sheath with a reinforcement ring. This provides a further improvement of the handling of the tobacco cartridge when used by the consumer for making his own cigarette; this reinforcement facilitates the introduction of the displacement plunger into the one end of the skein sheath for transferring the tobacco filling into the cigarette shell as well as the holding of the skein sheath in the surface of the displacement plunger during the transfer operation.

The reinforcement ring may be provided at its outer side with means increasing the grippability such as burls, a surface roughening or beads, or possible itself made as annular bead on the outer side of the skein sheath.

According to a particularly advantageous further development in conjunction with the aforementioned embodiment having a two-part plug unit bearing axially against the one end of the skein sheath, the reinforcement ring is made projecting beyond the end face of the skein sheath onto the cover, i.e. outer shell, of the plug unit and is fixedly connected to the plug cover in such a manner that the reinforcement ring forms the outer connecting element for securing the cover of the plug unit to the skein sheath end, the plug core loosely fitted in the cover of the plug unit being introduceable on axial displacement into the adjacent open end face of the skein sheath. The reinforcement ring and plug hereby have a uniform function. At the same time, this advantageous further development of the tobacco product is suitable for industrial production according to the method explained below optimally adapted to the existing technique for manufacturing filter cigarettes and the plant available therefor.

According to a modified embodiment, the grip ring may be fixedly connected both to the skein sheath and to the plug (one or more-part but in itself fixedly connected), and along a plane corresponding to the inner end face of the plug and perpendicular to the skein axis a desired breakage point is provided for example in the form of indentations, perforations or the like, thus enabling the portion containing the plug to be broken off for transfer of the tobacco skein.

The invention finally relates also to a method, optimally adapted to the existing technique of filter cigarette manufacture, for the industrial production of the tobacco product corresponding to the advantageous further development explained above with two-part plug unit, the procedure being that between two axially aligned sheathed tobacco skeins open at the end faces ("cigarette tobacco cartridges") a two-part plug unit is inserted comprising a plug cover or outer shell and a plug core loosely fitted in the latter, the plug unit having twice the axial length of a single plug, that in the joint region of the skein structure thus obtained axially symmetric with respect to the plug unit and engaging over the end faces thereof in each case a distance onto the outer side of the adjoining skein sheaths an outer ring of a suitable reinforcing material is provided and fixedly connected to the outer periphery of the skein sheaths and to the outer side of the cover of the plug unit, for example adhered, and that the continuous skein thus formed is then separated along a center plane perpendicular to the skein axis.

Examples of embodiment of the invention will be explained hereinafter with the aid of the drawings, wherein:

FIG. 1 shows in exploded perspective a system with which the smoker can make his own cigarette according to a preferred embodiment of the invention for use in conjunction with cigarette shells or wrappers of conventional type stuffed by the consumer himself, FIG. 2 shows the use of the system according to the invention of FIG. 1 in an intermediate stage in the making of the finished cigarette by the consumer, FIG. 3 shows the use of the system according to the invention in conjunction with cigarette paper of the type used in conventional manner by persons who roll their own cigarettes.

Figures 4A, 4B, 4C, 4D, 4E:
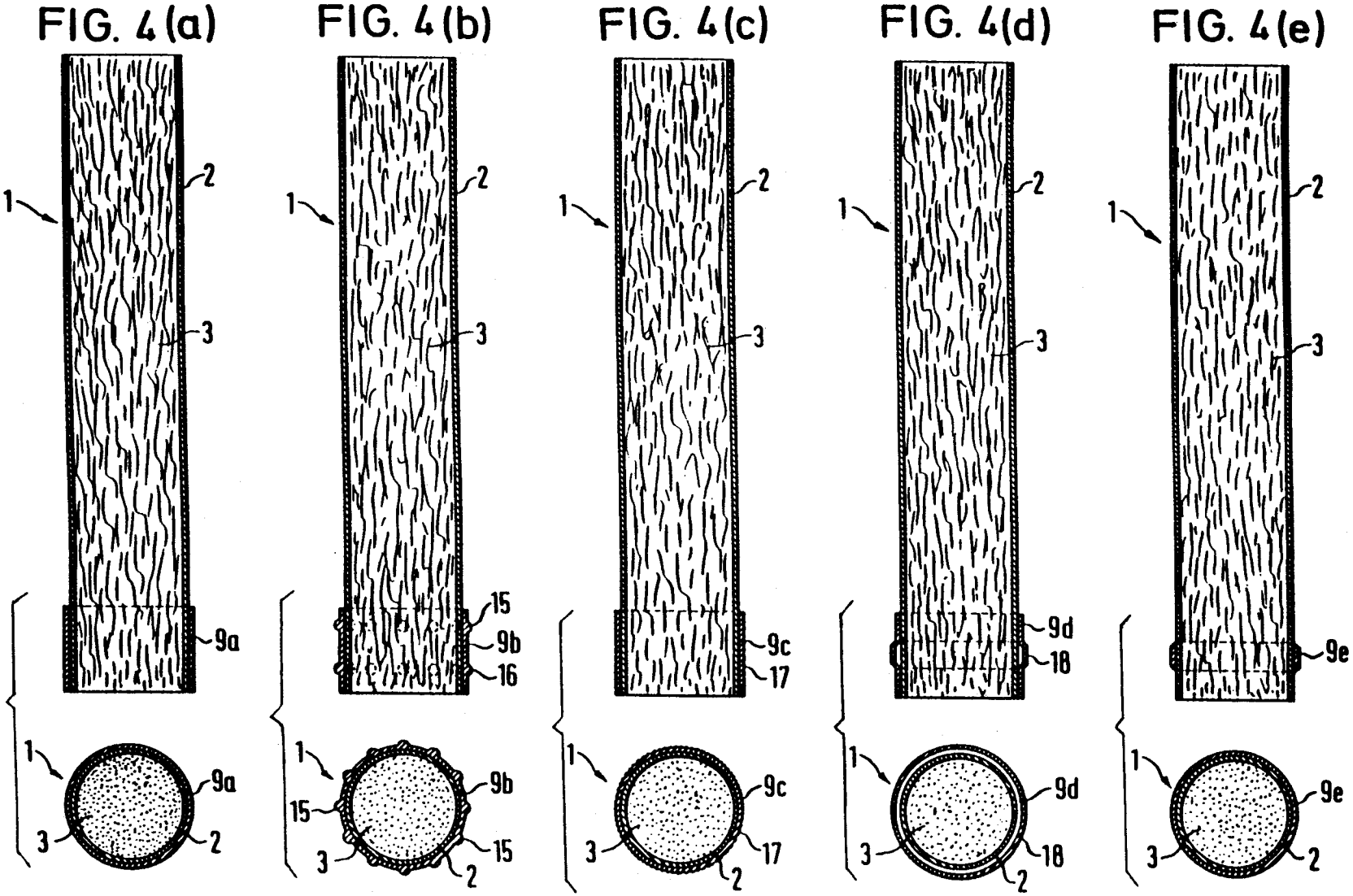
Figure 5:
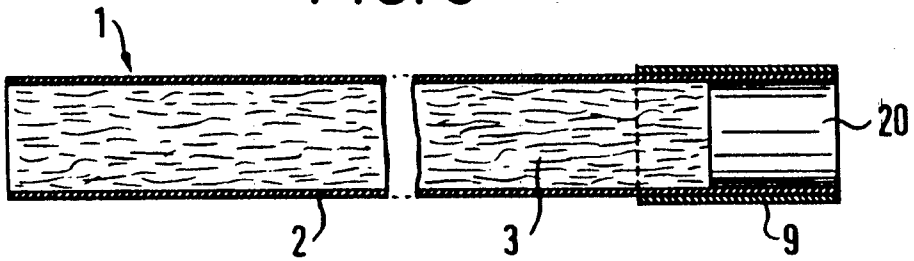
Figure 6:
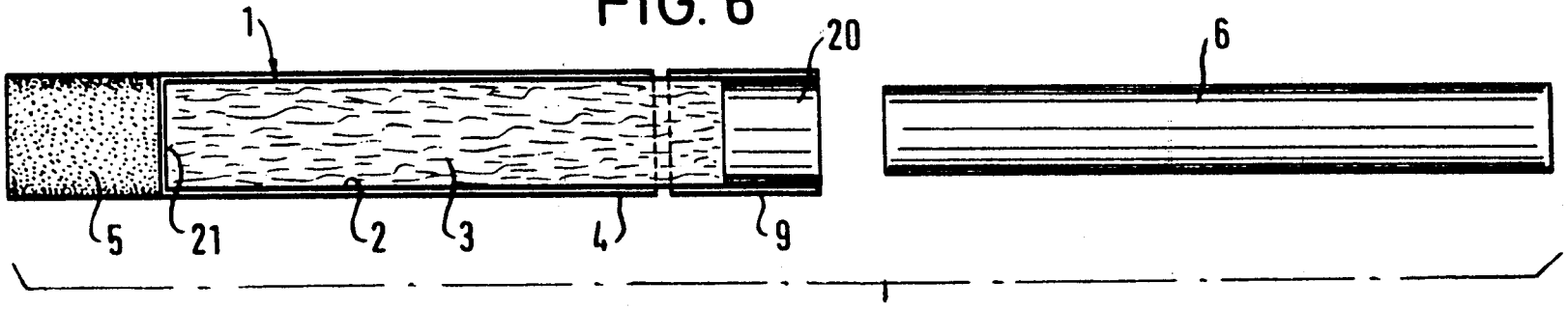
Figure 7:
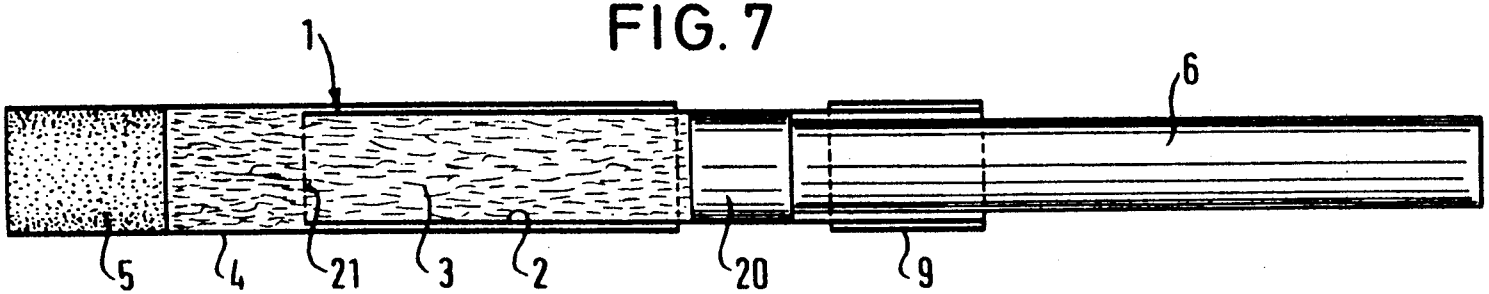
Figure 8A:
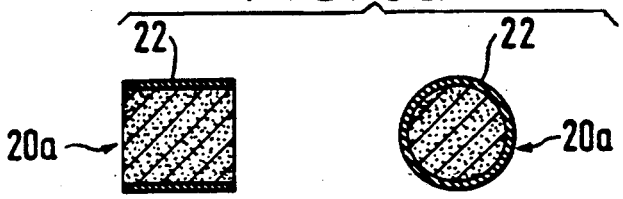
Figure 8B:
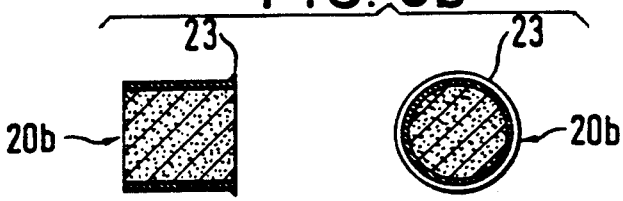
Figure 8C:
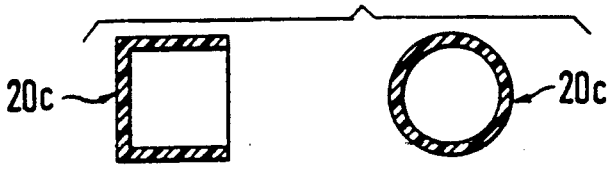
Figure 9:
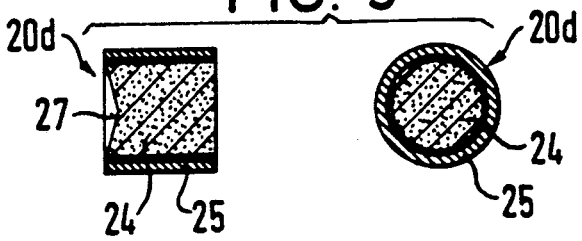
Figure 10:
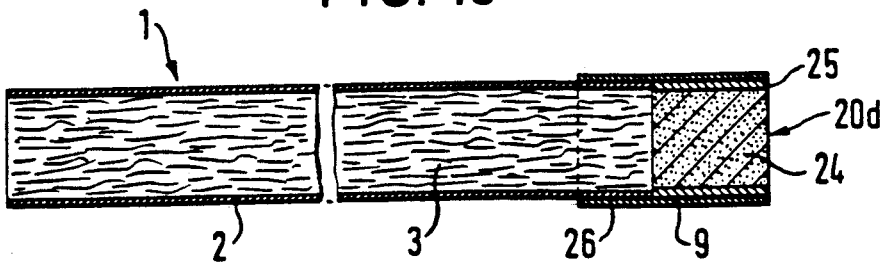
Figure 12:
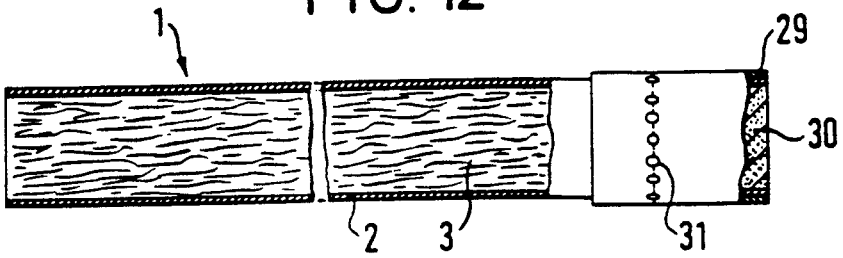
Figure 11:
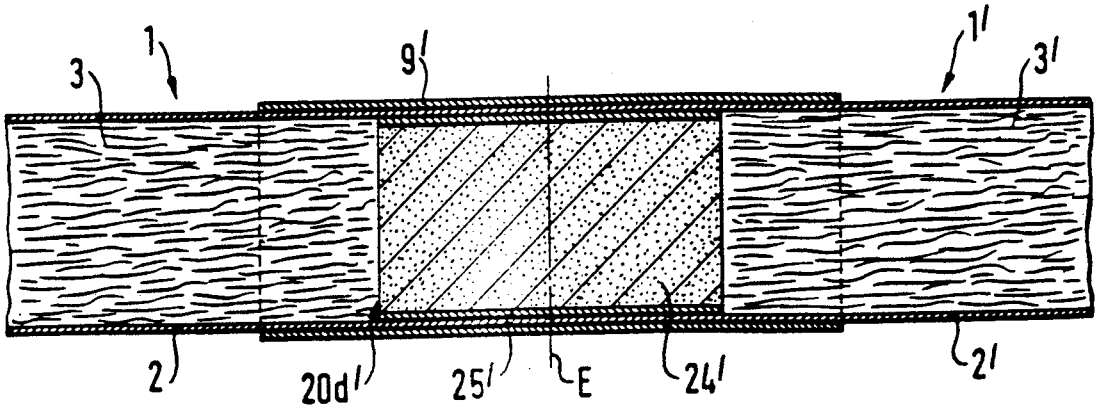

FIGS. 4*a*–4*e* show in axial longitudinal and cross-sectional view respectively cigarette tobacco cartridges according to the invention with reinforcement rings in various forms, FIG. 5 shows in axial longitudinal section a basic embodiment of a cigarette tobacco cartridge having a plug inserted at one end in accordance with an embodiment of the invention, FIGS. 6 and 7 show in axial longitudinal section the cigarette tobacco cartridge of FIG. 2 in various stages of the transfer of the tobacco filling into a filter cigarette paper shell, FIGS. 8*a*–8*c* show in axial longitudinal section and cross-sectional view respectively various embodiments of one-piece plugs, FIG. 9 shows in axial longitudinal section and cross-section a two-part plug construction according to a particularly advantageous further development of the invention, FIG. 10 shows in longitudinal section the two-part plug unit of FIG. 9 attached to the end face of a cigarette tobacco shell, FIG. 11 shows in axial longitudinal section a fragment of an advantageous production type of the cigarette tobacco cartridges according to FIG. 10, FIG. 12 shows in axial longitudinal section a modified embodiment of a cigarette tobacco cartridge according to the invention with fixedly attached plug separable by a desired breakage point.

FIG. 1 shows in exploded view a system enabling the consumer to make his own cigarettes according to a preferred embodiment of the invention, in the example of embodiment shown in association with a cigarette shell (with filter 5) of the conventional type used by persons who stuff their own cigarettes.

The essential element of the system according to the invention is the sheathed tobacco skein which is designated in FIG. 1 as a whole by 1. It consists of a skein sheath 2 of a thin preferably transparent (clear or translucent) material for example of a thin plastic foil material. The skein sheath 2 contains a skeinlike tobacco filling 3 (introduced by the manufacturer). The tobacco filling 3 in the skein sheath 2 is conveniently somewhat less tightly packed than in an ordinary cigarette and than desired for the final cigarette made by the consumer himself. The skein sheath 2 advantageously comprises a somewhat greater length than a commercially usual cigarette shell 4 (preferably with filter 5) into which in the embodiment of the invention shown in FIG. 1 the tobacco filling 3 of the skein 1 is to be transferred. The tobacco filling 3 corresponds in amount to the tight packing of the cigarette shell 4 desired for the finished cigarette corresponding to an ordinary industrially manufactured cigarette.

The skein sheath 2 is made with a somewhat smaller diameter than the commercially usual cigarette shells 4 in such a manner that the sheathed tobacco skein 1 of skein sheath 2 and filling 3 is easily introduceable into the commercially usual cigarette shell 4 (see also FIG. 2).

As further constituent the system according to the invention comprises a plunger 6 preferably constructed as simple circular rod, for example of wood or plastic, the external diameter of which is slightly less than the internal diameter of the skein sheath 2 in such a manner that the circular rod plunger 6 can be easily introduced into the skein sheath 2. For this purpose, the tobacco skein filling 3 in the sheath 2 at one end (on the right in the illustration of the drawings) does not extend quite to the end of the skein sheath so that a portion 7 at this end of the sheath remains free of tobacco; the circular rod plunger 6 can be easily introduced into said unfilled portion 7, the latter serving as guide for the further insertion of the plunger in the transfer of the tobacco filling 3 to the cigarette shell 4 described in detail below.

As mentioned, the skein sheath 2 consists of a thin foil-like material, preferably plastic foil material, which is preferably transparent so that the tobacco filling is visible. However, other possibly non-transparent foil materials may also be used, such as tin foil, aluminum foil or the like. The essential point is that the skein sheath material itself is not suitable for smoking so that it is excluded with certainty that the sheathed tobacco skein 1 can be smoked directly as a cigarette. For this purpose, according to an advantageous embodiment, it may additionally be provided that the skein sheath comprises perforations 8. The skein sheath can then also consist of a highly perforated non-combustible or poorly combustible paper. In this manner it is guaranteed with certainty that the sheathed filled tobacco skein 1 is technically and functionally not smokable and consequently not to be considered as a cigarette from the point of view of the fiscal laws. Furthermore, the skein sheath material should have on both sides an adequate surface smoothness to ensure at the outside good slideability between skein sheath 2 and cigarette shell 4 and at the inside good slideability between skein sheath 2 and tobacco skein filling 3. A further requirement is a certain adequate inherent stiffness of the thin foil material so as to ensure in conjunction with the consistency of the skeinlike tobacco filling 3 easy handling by the consumer.

Hereinafter with reference to FIG. 2 the making of a cigarette by the consumer himself with the aid of the system according to the invention will be explained, in the form using a cigarette shell of conventional type as employed by persons who stuff their own cigarettes. For this purpose, the sheathed or enveloped tobacco skein 1 containing the filling 3 is inserted into a cigarette shell of conventional type similar to the shell 4 in FIG. 1 (preferably with filter 5) with the end of the tobacco skein 1 at which the sheath 2 is filled up to its end face first so that as apparent in FIG. 2 in the fully inserted state the tobacco skein 1 at the other end of the cigarette paper shell 4 (FIG. 2, on the right) projects with its end portion 7 free of tobacco filling. As apparent from FIG. 2 according to the preferred embodiment the tobacco skein 1 also projects with a small portion 3*a* of the tobacco filling from the end of the surrounding cigarette shell 4 (corresponding to the looser filling of the tobacco skein 1 than corresponds to the desired packing density of the finished cigarette).

The plunger 6 also supplied is then introduced into the projecting end 7 of the skein sheath 2 free from the tobacco filling. In that the user presses the end of the skein sheath 2 between two fingers against the plunger 6, the plunger 6 is simultaneously introduced into the skein sheath 2 thus held (in FIG. 2 in the direction towards the left in the direction of the arrow S). The tobacco skein filling 3 is pushed at the opposite end of the skein sheath 2 out of the latter with simultaneously filling of the cigarette shell 4. The tobacco skein 3 somewhat longer in accordance with the somewhat loose filling 3 of the skein sheath 2 is compacted by the plunger 6 so that a firm filling of the cigarette shell results corresponding to a commercially usual industrially produced cigarette and in the finished condition the tobacco filling 3 is exactly flush with the end of the cigarette shell 4.

On insertion of the plunger 6 and pressing on the tobacco skein 3 out of the sheath 2 the cigarette shell 4 with increasing filling is pushed to the left out of the emptying skein sheath 2 in such a manner that finally on the left the completely stuffed firm cigarette comprising the shell 4 with tobacco filling 3 transferred into said shell drops off whilst the now emptied sheath 2 remains on the circular plungers and can be removed therefrom and discarded.

The system according to the invention has been explained above with reference to FIGS. 1 and 2 using a commercially usual cigarette shell as employed by persons who stuff their own cigarettes in conventional manner. However, the system according to the invention is also suitable for use in conjunction with cigarette paper as employed in conventional manner by persons who roll their own cigarettes. This type of use is illustrated in FIG. 3 (the same or corresponding parts are designated with the same reference numerals as in FIGS. 1 and 2). A cigarette paper 14 of conventional type is wrapped round the sheathed tobacco skein 1 according to the invention comprising the sheath 2 with tobacco filling 3 and gummed in the usual manner. Thereafter the tobacco skein filling 3 is pushed out with the circular rod plunger (not specially illustrated in FIG. 3); when this is done, the tobacco skein emerging from the end (on the left in FIG. 2) of the sheath 2, which on emergence from the sheath expands somewhat and thus comes to bear against the cigarette paper shell 14, entrains said shell whilst once again the skein sheath 2 is held by the user with two fingers at the right end against the circular plunger 6. In this type of use as well the consumer obtains in simple and completely unproblematical manner a uniformly firmly filled cigarette as can otherwise hardly be obtained by persons rolling their own cigarettes in the usual manner or can only be obtained with particular skill and a considerable expenditure of time.

The sheathed tobacco skein 1 forming the central part of the system according to the invention can be manufactured in simple manner in mass production similarly to cigarettes of conventional type. The production costs for the sheathed tobacco skein including the costs of the sheath, the tobacco filling, the filling operation and the cost of the plunger to be enclosed with a larger number of tobacco skeins are extremely low. The sheathed tobacco skeins 1 according to the invention can for example be packed exactly like loose cigarette fine cut tobacco in packets or suitable bundles; for example, with 50 g cigarette tobacco about 50 sheathed tobacco skeins 1 according to the invention can be made. With each such packet one or a few plungers 6 in the form of circular rods of wood or plastic may be enclosed.

Apart from the making by the smoker himself of uniformly filled cigarettes in simple unproblematical manner requiring no skill whatever, the system according to the invention has the further advantage that the tobacco by the additional enclosing in the skein sheaths better retains its freshness, the correct degree of moisture content and aroma.

In FIGS. 4–12 and the subsequent description other advantageous further developments of the invention are illustrated and explained.

According to such a preferred further development at the one end of the tobacco skein open at the end faces at the outer side of the skein sheath a reinforcement ring is provided which facilitates the introduction of a displacement plunger and the holding of the sheath on the plunger during the ejection operation for transferring the tobacco skein into the cigarette shell In the individual illustrations of FIG. 4 various embodiments of this improvement are shown each in longitudinal section and cross-section.

The sheathed tobacco skein designated as a whole by 1 comprises in each case the skein sheath 2 containing the tobacco filling 3. In the embodiment of FIG. 4*a* at the one end (at the lower end in the longitudinal section of FIG. 4*a*) the sheath 2 is provided at its outer side with a reinforcement ring 9*a*. Compared with the overall length of the sheathed skein the reinforcement ring need only have a relatively small axial extent (length). The reinforcement ring can be made of any desired material which ensures the certain desired stiffening of the skein sheath 2 at the grip end.

According to the embodiment of FIG. 4*b* the reinforcement ring 9*b* is provided with burls 15, 16 or the like for increasing the grippability. As illustrated, the burls can be distributed on a plurality (in the example of embodiment shown: two) of different levels round the sheathed skein periphery.

In the embodiment of FIG. 4*c* the reinforcement ring 9*c* is provided at its outer surface with a roughening likewise to increase the grippability.

In the embodiment according to FIG. 4*d* the reinforcement ring 9*d* is provided with an encircling bead 18 which in the example of embodiment illustrated is provided substantially at half the height (axial length) of the reinforcement ring 9*d*.

In the modified embodiment illustrated in FIG. 4*e* the grip ring 9*e* comprises a bead fitted directly onto the outside of the skein sheath 2.

On the whole, the arrangement of such a reinforcement ring at the one end of the skein sheath open at the end faces provides a further improvement in the handling of the sheathed tobacco skein when used by the consumer for making his own cigarettes. The introduction of the displacement plunger into the one end of the skein sheath for transferring the tobacco filling into the cigarette shell not shown in FIG. 4) is facilitated by this reinforcement as in the holding of the skein sheath on the surface of the displacement plunger during the transfer operation.

According to a further development of the invention to ensure (on its own or possibly additionally) the non-smokability of the prefabricated sheathed tobacco skein open at the end faces according to the invention ("cigarette tobacco cartridge") in the one end thereof a plug ma inserted in movable detachable manner. This firstly guarantees the non-smokability of the cigarette tobacco cartridge (as is provided by and essential to the underlying idea of the invention) and secondly the plug inserted preferably slidingly movably into the skein sheathing can serve as plunger head in the transfer of the tobacco skein from the sheath into the final cigarette paper shell so that the associated displacement plunger need not be adapted in its diameter dimension so exactly to the internal diameter of the skein sheath.

FIG. 5 shows in (partially broken away) longitudinal section the principle of this aspect of the invention. At the one open end (on the right in FIG. 5) of the skein beneath 2 a plug 20 is inserted in loose manner, i.e. without fixed connection to the sheath 2, i.e. in particular not adhered thereto. The plug 20 is thus slidingly displaceable in the skein sheath 2.

The (movably detachably inserted) plug 20 guaranteed with certainty the non-smokability of the sheathed tobacco skein ("cigarette tobacco cartridge") industrially manufactured as prefabricated product for the consumer, possibly additionally to the measures adopted in this respect explained above (use of a non-combustible material for the 2 and/or arrangement of perforations in the skein sheath). In addition, the plug 20 inserted movably detachably into the open end of the skein sheath 2 and in close easily slideable engagement in the interior of the sheath with the inside thereof can serve as plunger head for the displacement plunger in the transfer of the tobacco skein 3 into the cigarette paper shell of the cigarette made by the consumer himself. The use of a prefabricated product according to the invention improved according to FIGS. 4 and 5 by providing an outer grip ring and insertion of an end plug in making cigarettes by the consumer himself is illustrated in FIGS. 6 and 7 in each case in longitudinal section (and once again identical or corresponding parts are provided with the same reference numerals).

In detail, FIG. 6 shows schematically (wall of the individual parts in section indicated only by a dashed line) the condition after the user has inserted the sheathed tobacco skein 1 with its end 21 opposite the plug 20 and reinforcement grip ring 9 into a cigarette paper shell of conventional type until engagement with the filter extension 5 of the cigarette paper shell. On the right of FIG. 6 the associated displacement plunger 6 is shown which serves for transfer of the tobacco skein 3 into the cigarette paper shell 4 for making the finished cigarette.

FIG. 7 illustrates the condition during the transfer of the tobacco skein 3 into the cigarette paper shell 2. The plunger 6 is introduced into the end of the sheath 2 provided with the reinforcement ring 9 and already displaced a distance to the left; the introduction operation and the holding of the sheath 2 on the surface of the displacement plunger 6 necessary for the transfer operation are facilitated by the reinforced grip end 9 of the skein sheath 2. As apparent the plug 20 serves during the transfer operation in advantageous manner as plunger head for the displacement plunger 6 whose dimensioning with respect to the skein sheath internal diameter is thus less critical. By continued insertion of the displacement plunger 6 into the skein sheath 2 held firmly on the outer surface thereof by means of the grip ring 9 the tobacco skein 1 is gradually introduced into the cigarette paper shell 4. The axial length of the sheath 2 is dimensioned such that after the complete transfer of the tobacco skein 3 into the cigarette paper shell 4 (with corresponding compacting of the tobacco skein in the latter) the plug 20 is disposed at the left end of the sheath 2 fully introduced into the latter.

There are various possibilities for the making of the plug 10 as regards material and shape. For example, the plug may consist of paper, board, organic materials, plastics, in each case with a good sliding outer surface or cover. Examples or possible configurations of the plug are illustrated in FIG. 8*a* to 8*c* (in each case in axial longitudinal section and associated cross-section). FIG. 8*a* shows a form of the plug as simple cylindrical body 20*a* which can possibly (but not necessarily) be provided with an outer shell or cover 22 (fixedly connected to the plug core). FIG. 8*b* shows an embodiment in which the likewise substantially cylindrically formed plug 20*b* is provided at its outer (with respect to the insertion into the skein sheath) end face with a sealing lip 23, said sealing lip reliably ensuring firstly the non-smokability and secondly the desired relatively close engagement with the skein sheath inner side in the transfer operation. FIG. 8*c* illustrates an embodiment in which the plug is made as a pot or cup-shaped hollow body 20*c* closed at one end faces. This embodiment is suitable more especially when the plug is made of a plastic material, it being possible to make the hollow body 20*c* by the drawing or injection molding method.

In the embodiments hitherto described with reference to FIG. 8 the closure plug 20 forms in each case an integral structure; if as indicated for example in FIG. 5*a* the plug core is provided with its own cover 22, said cover is fixedly connected to the plug core, for example adhered. A modified embodiment which is particularly advantageous as regards production technique is illustrated in FIGS. 9 to 11. According to FIG. 9 the plug 20*d* is made in two parts with a core 24 and an outer shell or cover 25 and in this case the core and cover are not fixedly connected to each other, i.e. in particular are not adhered to each other, the core being loose in the cover and therefore axially displaceable with respect thereto. FIG. 10 illustrates the arrangement of the plug 20*d* according to this embodiment of FIG. 9 on the sheathed tobacco strand ("cigarette tobacco cartridge") in conjunction with reinforcement grip ring according to the aspect explained above. The plug 20*d* in this embodiment lies outside skein sheath 2 against the open end face thereof in such a manner that the cover 25 of the plug adjoins the skein sheath 2 at the end face. The plug 20*d* is held in its position in that the cover 25 of the plug is fixedly connected, for example adhered, at its outside to the inner wall of the reinforcement ring 9. For this purpose the reinforcement ring 9 is made to project in the axial direction beyond the end face of sheath 2 by the axial length of the plug 20*d*. With its region 26 lying on the outer periphery of the skein sheath 2 the grip ring 9, as in the embodiments according to FIG. 4, is fixedly connected, for example adhered, to the outside of the sheath 2. For transferring the tobacco skein 3 into the cigarette paper shell the procedure outlined above with reference to FIGS. 6 and 7 is adopted, and in the present case only the plug core 24 (loosely disposed in its cover 25) is displaced by the plunger 6.

The embodiment explained above according to FIGS. 9 and 10 permits a particularly simple industrial production similar to the conventional production of filter cigarettes in that the prefabricated or intermediate product according to the invention (sheathed tobacco skein with closure plug and reinforced grip ring end) can be made with extensive adoption of the existing sophisticated production techniques for filter cigarettes and the existing production plants. This production is illustrated in FIG. 11 in an axial longitudinal section. Between two axially aligned beneath tobacco skeins ("cigarette tobacco cartridges") 1, 1' comprising in each case a sheath 2, 2' and tobacco skein 3, 3' a plug element **20*d*' corresponding in its structure to the plug 20*d* of FIGS. 9, 10 but having twice the axial length of a plug is inserted and thus consists of the plug core 24' and the plug cover 25'. The plug element 20*d*' bears at the axial end faces against the two cigarette tobacco cartridges 1, 1' and has the same external diameter as the latter sc that a continuous strand 1, 2*d*'' 1' is formed. As described with the aid of FIGS. 9 and 10 the core 24' of the plug element 20*d*' is disposed loosely in cover 25', for example metal foil outer shell, i.e. is not adhered to the latter. Then, in the manner known per se in the production of filter cigarettes, at the joint region of the aforementioned skein structure, 1, 20*d*', 1' an outer ring 9' is disposed axially symmetrically with respect to the plug element 20*d*' and projecting beyond the end faces thereof in each case a corresponding distance onto the outside of the adjoining skein sheaths 2, 2'. This outer ring 9' is fixedly connected, for example adhered, to the outer periphery of the skein sheaths 2, 2' and the outside of the cover 25' of the plug element 20*d*'. The continuous strand thus formed is then severed by a corresponding cutting device in the cut plane indicated at E perpendicular to the strand axis. In this manner two cigarette tobacco cartridges 1, 1' of the type illustrated in FIG. 10 are obtained, the two halves of the outer ring 9' forming the reinforcement grip ring 9 of each cartridge and the halves of the plug element 20*d*' forming the end plug of each cartridge with the cover 25 held by the grip ring 9 and the plug core 24 loosely disposed in said cover 25** and thus axially displaceable.

In this manner the cigarette tobacco cartridges according to the invention in the aforementioned particularly advantageous further development (with non-smokable plugs; grip ring) may be industrially manufactured with extensive adaptation and adoption of the available production technique for filter cigarettes, the grip ring and plug being integrated with each other.

According to FIG. 9 the plug may be formed at its inner end face facing the tobacco skein with a conical depression 27 by which on transfer of the tobacco skein a concentrating compacting effect is exerted thereon. Of course, it is conical depression 27 can also be provided in the other embodiments of the plugs **20*a*, 20*b* and 20*c* illustrated in FIG. 8**

According to a modified embodiment illustrated in FIG. 12 the grip ring 29 may be fixedly connected both to the skein sheath 2 and to the plug 30 (one or more part but fixedly connected in itself). Along a plane corresponding to the inner end face of plug 30 and perpendicular to the skein axis a desired breakage point 31 is provided, for example in the form of indentations, perforations or the like, enabling the portion containing the plug 30 to be broken off for transfer of the tobacco skein, the tobacco cartridge 1, 2 remaining with the rest of the ring 29 as reinforcement grip ring for use in the manner described above.

I claim:

1. Ready-to-use set for making of cigarettes by hand by the consumer, the set comprising:

a shell of cigarette paper for receiving tobacco therein;

a prefabricated tobacco product having the form of a tobacco cartridge which is itself not smokable, and which comprises a sheath for containing a skein of tobacco, and a skein of smokable tobacco disposed in the sheath, the tobacco cartridge having an outer diameter and the shell of paper having an inner diameter, the outer diameter of the tobacco cartridge being slightly less than the inner diameter of the shell for enabling the sheath to be moved into the shell;

a free hand holdable and, hand manipulatable, loose plunger rod for being pushed into the sheath of the tobacco cartridge as the cartridge is being held free-handedly for moving the tobacco skein in the sheath out of the sheath and into the paper shell in which the tobacco cartridge is disposed, the plunger rod having an outer diameter which is slightly less than the inner diameter of the sheath of the tobacco cartridge, whereby force can be applied to the tobacco skein by moving the plunger rod into the sheath for forcing the tobacco out of the sheath and into the shell.

2. The set of claim 1, wherein the cigarette paper shell is a tube having at least one open end for receiving the tobacco cartridge therein and the sheath is a tube having opposite ends, one end of the sheath for receiving the plunger therein and the other end of the sheath for having the tobacco ejected therefrom and into the shell, and at least the other end of the sheath being disposed in the shell.

3. The set of claim 1, wherein the cigarette paper shell is comprised of a prefabricated paper tube.

4. The set of claim 3, further comprising a filter disposed on one end of the paper tube, the paper tube having an opposite end into which the cartridge is inserted.

5. The set of claim 1, wherein the sheath is comprised of a material which is not suitable for smoking.

6. The set of claim 1, wherein the sheath is perforated.

7. The set of claim 1, wherein the sheath is comprised of a perforated paper with a plurality of perforations therethrough.

8. The set of claim 1, wherein the sheath is comprised of a thin foil material selected from the group consisting of plastic foil, tin foil and aluminum foil.

9. The set of claim 1, wherein the length of the tobacco skein in the sheath is shorter than the length of the sheath and the tobacco skein is so positioned in the sheath that one end portion of the sheath is free of the tobacco skein filling and the one end portion is at the end of the sheath for receiving the plunger rod.

10. The set of claim 1, wherein the skein of tobacco in the sheath has a first length, the cigarette shell has a portion thereof into which the tobacco skein is ejected from the sheath, and the portion of the cigarette paper shell into which the tobacco is to be inserted is of relatively shorter length while the length is of relatively greater length.

11. The set of claim 10, wherein the length of the tobacco skein in the sheath is shorter than the length of the sheath and the tobacco skein is so positioned in the sheath that one end portion of the sheath is free of the tobacco skein filling;

and wherein the sheath and the filling of tobacco therein are so dimensioned that with the sheath fully inserted into the shell, the portion of the sheath that is free of filling and a small portion of the tobacco skein within the sheath extend beyond and project from the end of the cigarette shell at which the free end portion of the sheath is disposed.

12. The set of claim 1, wherein the tobacco cartridge has a greater length than the cigarette paper shell.

13. The set of claim 1, further comprising a plug disposed at one end of the sheath and in engagement with the inside of the sheath and being axially displaceable with respect to the sheath.

14. The set of claim 13, wherein the sheath is open at an end, the plug is disposed at the open end and the plug has an outer periphery that bears against the interior of the sheath.

15. The set of claim 14, wherein the plug comprises a plug core and a slidable cover fixedly connected to the core.

16. The set of claim 14, further comprising a reinforcement ring disposed at the outside of the sheath toward the end thereof that is generally outward of the paper shell, wherein the plug is two-part plug comprising an internal core and an external cover around the core; the reinforcement ring is projected beyond the end of the sheath and onto the cover of the plug and is affixed to the plug cover, wherein the reinforcement ring secures the cover of the plug to the skein sheath, the core of the plug fitting loosely in the cover of the plug and the core being introduceable into the open end of the skein sheath at which the plug is disposed.

17. The set of claim 13, wherein the plug is disposed adjoining the open end of the sheath and in coaxial alignment therewith.

18. The set of claim 1, further comprising a reinforcement ring disposed at the outside of the sheath toward the end thereof that is generally outward of the paper shell.

19. The set of claim 18, further comprising means on the outside of the reinforcement ring for increasing its grippability.

20. A method for making cigarettes by hand by the consumer comprising placing a prefabricated tobacco cartridge, which is itself not smokable and which comprises a sheath and a skein of tobacco in the sheath, into an associated shell of cigarette paper for receiving the tobacco cartridge, wherein the outer diameter of the tobacco cartridge is slightly less than the inner diameter of the cigarette paper shell, the emplacement being in a manner such that the sheath has an open end which projects outside the cigarette paper shell at one end of the shell for being grippable by one hand;

introducing with the other hand a free, hand manipulatable, loose plunger rod into the open projecting end of the sheath of the tobacco cartridge, while holding the sheath with the one hand against moving upon application of force to the plunger rod to move it into the sheath, and transferring the tobacco skein from the sheath and into the cigarette paper shell by ejecting the tobacco skein from the sheath by axially advancing the tobacco skein from the sheath and into the cigarette paper shell by advancing the hand held plunger rod using the other hand, into the sheath for ejecting the tobacco from within the sheath to outside the opposite end of the sheath and into the inside of the cigarette paper shell for the ejected tobacco to engage the interior of the paper shell and to push the paper shell off the sheath as the paper shell is filled by the tobacco emerging from the sheath and into the shell, with the sheath being held by the one hand against movement while transferring the tobacco skein from the sheath into the cigarette paper shell.

21. The method of claim 40, wherein prior to placing the tobacco cartridge into the shell, forming the shell from a sheet of conventional cigarette paper by gluing the sheet on itself.

22. A method for making cigarettes by hand by the consumer utilizing a prefabricated tobacco product, which is itself not smokable, in the form of a tobacco cartridge comprising a sheath and a skein of tobacco in the sheath, said method comprising:

placing said tobacco cartridge in an associated shell of cigarette paper of suitable diameter to receive the tobacco cartridge, the placing being in a manner such that said tobacco cartridge projects from one end of the cigarette paper shell for being grippable by one hand;

free-handedly introducing with the other hand an associated free, hand manipulatable loose plunger rod into the open projecting end of the tobacco cartridge while holding with said one hand said sheath of said tobacco cartridge against movement by the introduction of said plunger rod;

ejecting the tobacco skein filling of said cartridge from the cartridge sheath held fixedly with said one hand by axially advancing the freely hand-held plunger rod with said other hand into the sheath for ejecting the tobacco from within the sheath to outside the opposite end of the sheath and into the inside of the cigarette paper shell for the ejected tobacco to engage the interior of the paper shell and to push the paper shell of the sheath as the paper shell is filled by the tobacco emerging from the sheath and into the shell, with said sheath being held by said one hand against movement, while transferring said tobacco skein from said sheath into said cigarette paper shell.

* * * * *